US007709717B2

(12) United States Patent
Nonaka

(10) Patent No.: US 7,709,717 B2
(45) Date of Patent: May 4, 2010

(54) STRUCTURE FOR ELECTRONIC KEYBOARD INSTRUMENT

(75) Inventor: Kenkichi Nonaka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/968,627

(22) Filed: Jan. 2, 2008

(65) Prior Publication Data

US 2008/0163740 A1 Jul. 10, 2008

(30) Foreign Application Priority Data

Jan. 5, 2007 (JP) ..... 2007-000837
Jan. 5, 2007 (JP) ..... 2007-000838

(51) Int. Cl.
*G10C 3/12* (2006.01)

(52) U.S. Cl. ..... 84/423 R; 84/177

(58) Field of Classification Search ..... 84/423 R, 84/177

See application file for complete search history.

(56) References Cited

U.S. PATENT DOCUMENTS 5,164,528 A * 11/1992 Arai et al. ..... 84/177
5,398,161 A * 3/1995 Roy ..... 361/727
2003/0051594 A1 3/2003 Ishihara et al.
2004/0112199 A1 6/2004 Ishihara et al.
2005/0103181 A1 5/2005 Ishihara et al.

FOREIGN PATENT DOCUMENTS

JP 10-126015 5/1998
JP 2004-171038 6/2004

* cited by examiner

*Primary Examiner*—Jianchun Qin
(74) *Attorney, Agent, or Firm*—Morrison & Foerster LLP

(57) ABSTRACT

Structure for an electronic keyboard instrument includes upper and lower cases. The lower case has a bottom plate having lower slits, and the upper case has an upper plate having upper slits. The upper and lower cases are fastened together with the upper case overlapped on the lower case and with opposite edge portions of a circuit board inserted in the lower and upper slits in such a manner that the circuit board is disposed upright between the upper and lower cases. Heat radiating plate is attached to the circuit board. A wiring, drawn out from an operation section provided on the upper case, is wired to pass across a neighborhood of the upper end surface of the heat radiating plate under the lower surface of the upper plate. Heat blocking plate is provided between the heat radiating plate and the wiring to block transfer of heat from the heat radiating plate to the wiring.

12 Claims, 4 Drawing Sheets

STRUCTURE FOR ELECTRONIC KEYBOARD INSTRUMENT

BACKGROUND

The present invention relates generally to structures for electronic keyboard instruments. More particularly, the present invention relates to an improved structure for an electronic keyboard instrument which includes a lower case having a bottom plate for mounting thereon a keyboard unit on a portion thereof closer to a human player (i.e., on a player-side portion of the bottom plate) and an upper case having an upper plate to cover an upper portion of the lower case, and in which the upper case is overlapped on the lower case from above the lower case. Further, the present invention relates to an improved structure for an electronic keyboard instrument of a type where an operation section is provided on the upper surface of the upper plate.

In recent years, circuit boards to be incorporated in electronic keyboard instruments have been getting smaller and smaller, and it has become possible to house a circuit board in an upright position or posture within a housing. One example of such electronic keyboard instruments is disclosed in Japanese Patent Application Laid-open Publication No. 2004-171038. In the disclosed electronic keyboard instrument, an instrument housing comprises two major components: a housing body section; and a rear housing section.

The housing body section includes a bottom plate for mounting thereon a keyboard unit, and the bottom plate has openings in its upper and back sides. On the rear housing section, there are provided a roof plate portion (upper plate) that covers the upper opening of the housing body section and a back plate portion that covers the back opening of the housing body section. Further, a main circuit board is mounted, by screwing or the like, to the back plate portion of the rear housing section in an upright position. In assembling the housing of such a conventionally-known electronic keyboard instrument, the main circuit board is mounted to the back plate portion of the rear housing section, and then the rear housing section is mounted to the housing body section by being sled relative to the housing body section frontward, i.e. toward a position where a human player of the keyboard instrument is supposed to be at the time of playing (hereinafter also referred to as "player side").

However, with the housing of the aforementioned conventionally-known electronic keyboard instrument, it is necessary to screw the main circuit board to the back plate portion of the rear housing section, and thus, separate screwing operation has to be performed. Consequently, there has been encountered the problem that the assembling work tends to be extremely cumbersome.

Further, an operation section, including operation buttons etc., is provided on the upper surface of the roof plate portion of the rear housing section. Wiring section, drawn out from the operation section, is wired beneath and along the lower surface of the roof plate portion and connected to the main circuit board. In some cases, the wiring is wired to pass across a neighborhood of the upper end surface of a heat radiating plate provided on the main circuit board beneath the roof plate. Consequently, heat is dissipated toward the wiring section, so that there would occur inconveniences, such as unwanted melting of the coating of the wiring due to the heat from the heat radiating plate. Further, Japanese Patent Application Laid-open Publication No. HEI-10-126015 discloses forming perforated lines in a printed circuit board and removing unnecessary circuit board portions along the perforated lines at the time of attachment or mounting of the circuit board. However, so far, the removed circuited board portions have been discarded as unnecessary.

SUMMARY OF THE INVENTION

In view of the foregoing, it is an object of the present invention to provide an improved structure for an electronic keyboard instrument which can be assembled easily in a simplified manner.

It is another object of the present invention to provide an improved structure for an electronic keyboard instrument which can reliably prevent a wiring section from being adversely influenced by heat from a heat radiating plate.

In order to accomplish the above-mentioned objects, the present invention provide an improved structure for an electronic keyboard instrument which comprises a lower case having a bottom plate for mounting thereon a keyboard unit and an upper case having an upper plate covering the lower case, the structure further comprising: a first holding section provided on the bottom plate of the lower case and having a lower slit formed therein, the lower slit having an upward opening; a second holding section provided on the upper plate of the upper case and having an upper slit formed therein, the upper slit having a downward opening; and a circuit board disposed upright between the upper case and the lower case. When the lower case is covered with the upper case, the circuit board is fixed in place by being inserted at upper and lower edge portions thereof in the upper slit and lower slit, respectively.

According to the present invention arranged in the aforementioned manner, the circuit board can be appropriately held in place by being sandwiched vertically by the upper and lower cases, and thus, no particular screwing operation is required for mounting the circuit board to the upper and lower cases. Besides, the circuit board can be mounted to the upper and lower cases during the same time as mounting of the upper case to the lower case. As a result, the assembling work of the structure can be done easily in a simplified manner. Further, the circuit board can function as a reinforcement means for vertically reinforcing the upper and lower cases, so that the upper and lower cases can be prevented from undesirably deforming due to external force. Furthermore, with the circuit board sandwichingly held at its upper and lower edge portions between the upper and lower cases, the circuit board can be reliably prevented from falling and thus can be securely fixed within the upper and lower cases.

In an embodiment, the first holding section is provided on a portion of the bottom plate of the lower case remoter from a human player of the keyboard instrument than the keyboard unit, the second holding section is provided on a portion of the upper plate remoter from the human player than the keyboard unit, and the upper case and the lower case are fastened together by means of fastening elements with the lower case covered with the upper case.

In an embodiment, a heat radiating plate is disposed on a side of the circuit board remote from the human player. Thus, the heat radiating plate is provided remote from the keyboard with the circuit board interposed between the heat radiating plate and the keyboard, which can reliably prevent heat from being trapped in the keyboard unit. If the heat radiating plate is provided between the circuit board and the keyboard unit, heat would be trapped in a resin-made frame of the keyboard unit, so that imbalanced heat distribution would occur in the frame of the keyboard unit. As a consequence, the frame of the keyboard unit twists and the keyboard unit loses its flatness, so that uniformity among touch responses of the individual keys would be adversely influenced and thus the performance capability of the keyboard would deteriorate. However, in the present invention, where the heat radiating plate is disposed on the side of the circuit board remote from the human player (i.e., on the remote-from-player side of the circuit board), it is possible to prevent heat from being trapped in the keyboard unit. Thus, the present invention can effectively prevent the uniformity among the touch response of the individual keys and performance capability of the keyboard from deteriorating due to transfer of heat from the circuit board.

In an embodiment, the structure includes a heat radiating plate having concave and convex portions, and the heat radiating plate is provided in opposed relation to the circuit board in such a manner that vertical through-spaces are formed between the circuit board and the concave and convex portions. Here, the heat radiating plate is fixed to the circuit board in opposed relation thereto so that through-spaces extending in the vertical direction are formed between the circuit board and the concave and convex portions of the heat radiating plate, and thus, the circuit board can be mechanically reinforced by the heat radiating plate. As a result, the circuit board can even further reinforce the upper and lower cases, so that the upper and lower cases can be even more reliably prevented from deforming due to external force. In addition, because the through-spaces form air passageways in the vertical direction, it can even further enhance the heat-radiating effect.

In an embodiment, the lower slit of the first holding section includes first and second lower slits provided in such a manner that the circuit board is first inserted into the first lower slit and then inserted into the second lower slit following the insertion into the first lower slit. Because the circuit board is inserted into the first and second lower slits with some time difference, the circuit board can be attached smoothly to the lower case. Further, the first and second lower slits can cooperate to appropriately align the circuit board in a thickness direction of the circuit board.

In an embodiment, the lower slit of the first holding section includes first and second lower slits, and an opening of the first lower slit is located closer to the upper case than an opening of the second lower slit. Because the circuit board is inserted into the first lower slit and then into the second lower slit, the circuit board can be attached smoothly to the lower case. Further, the first and second lower slits can cooperate to appropriately align the circuit board in the thickness direction of the circuit board.

In an embodiment, the first lower slit and the second lower slit are arranged in alignment substantially along a key-arranged direction. With the first and second lower slits arranged in alignment substantially along the key-arranged direction, the circuit board can be securely held within the cases.

In an embodiment, the structure includes a resilient or cushioning member provided on at least one of outer surfaces of the circuit board and inner surfaces of the slit. With the resilient or cushioning member, the circuit board can be securely fixed within the slit with no wobble. Consequently, it is possible to prevent mechanical noise from being produced in tones generated by the keyboard instrument and thereby prevent generation of buzzer-like sound noise.

In an embodiment, the first holding section includes: a lower projecting portion that projects from the bottom plate toward the upper case and has the lower slit formed therein; a positioning wall portion that projects from the bottom plate toward the upper case and positions the circuit board in a key-arranged direction; and a connecting portion that interconnects the lower projecting portion and the positioning wall portion. The provision of the positioning wall portion allows the circuit board to be appropriately positioned in the key-arranged direction. Besides, with the integral formation, via the connecting portion, of the lower projecting portion and positioning wall portion, the positioning wall portion and lower projecting portion can be effectively reinforced.

According to another aspect of the present invention, there is provided a structure for an electronic keyboard instrument which includes: a lower case having a bottom plate for mounting thereon a keyboard unit; and an upper case having an upper plate covering the lower case and an operation section mounted on an upper surface of the upper plate, the structure further comprising: a circuit board provided between the upper case and the lower case and having a heat-radiating plate attached thereto; a wiring drawn out from the operation section and wired to pass across a neighborhood of an upper end surface of the heat radiating plate at least under a lower surface of the upper plate; and a heat blocking plate mounted to the upper plate. Here, the heat blocking plate is provided between the heat radiating plate and the wiring, and the heat blocking plate blocks transfer of heat from the heat radiating plate to the wiring. The heat blocking plate can block transfer of heat from the heat radiating plate to the wiring, and thus, it is possible to prevent inconveniences from being produced in the wiring due to influences of the heat from the heat radiating plate.

In an embodiment, the operation section includes an operation-section circuit board provided beneath and along the lower surface of the upper plate, and the heat blocking plate is provided by being initially formed integrally with the operation-section circuit board with a perforated line therebetween and then cut from the operation-section circuit board along the perforated line. With this arrangement, it is possible to prevent the heat blocking plate from being lost if it is kept integral with the operation-section circuit board until the operation-section circuit board and heat blocking plate are attached to the upper and lower cases.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

Figure 1A:
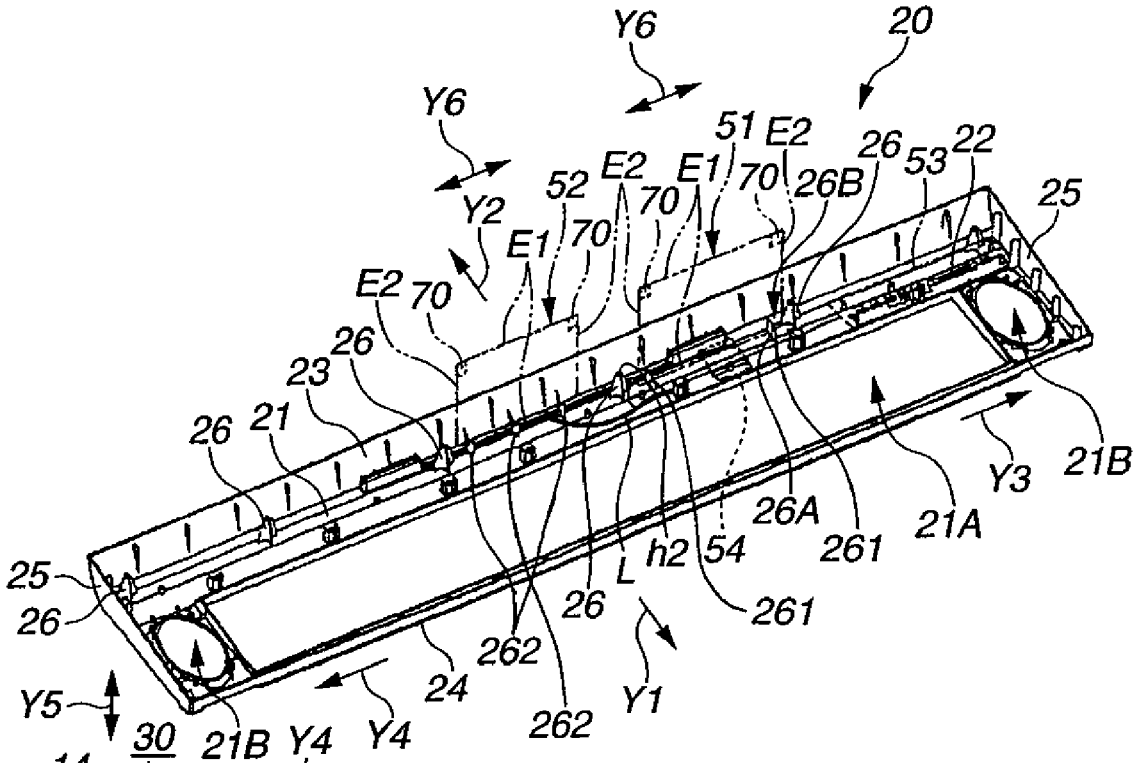
FIG. 1A is a lower perspective view of an upper case constituting a structure for an electronic keyboard instrument in accordance with an embodiment of the present invention, which particularly shows an inner or reverse side of the upper case.
Figure 1B:
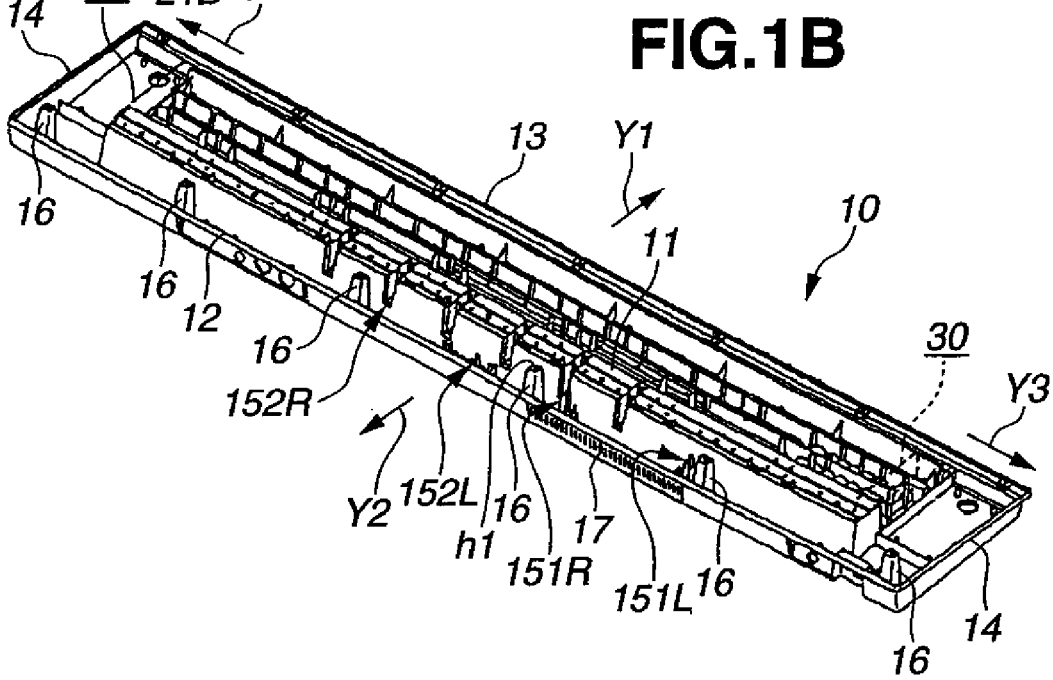
FIG. 1B is an upper perspective view of a lower case constituting the structure together with the upper case.
Figure 2:
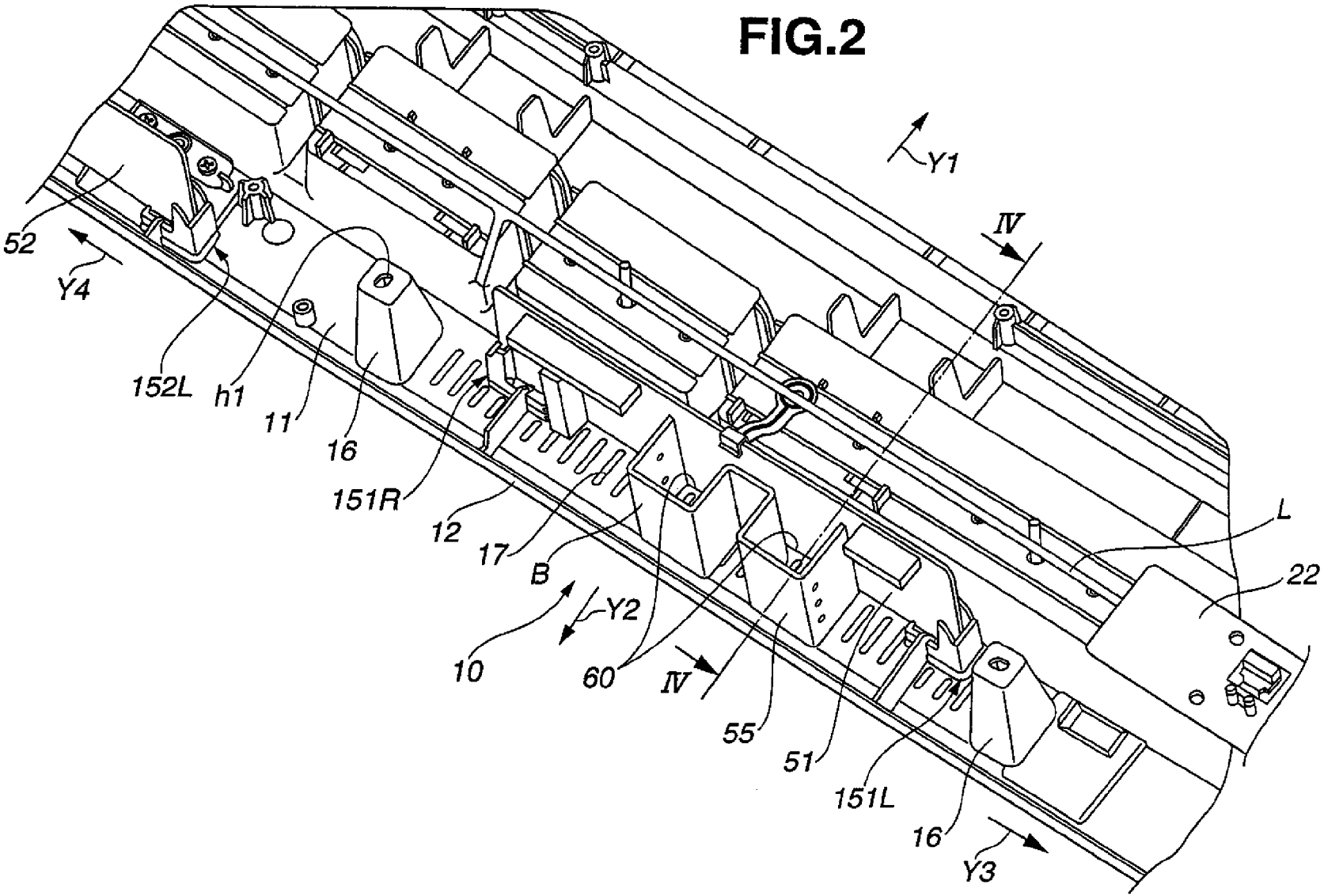
FIG. 2 is a fragmentary enlarged perspective view of the lower case shown in FIG. 1.
Figure 3:
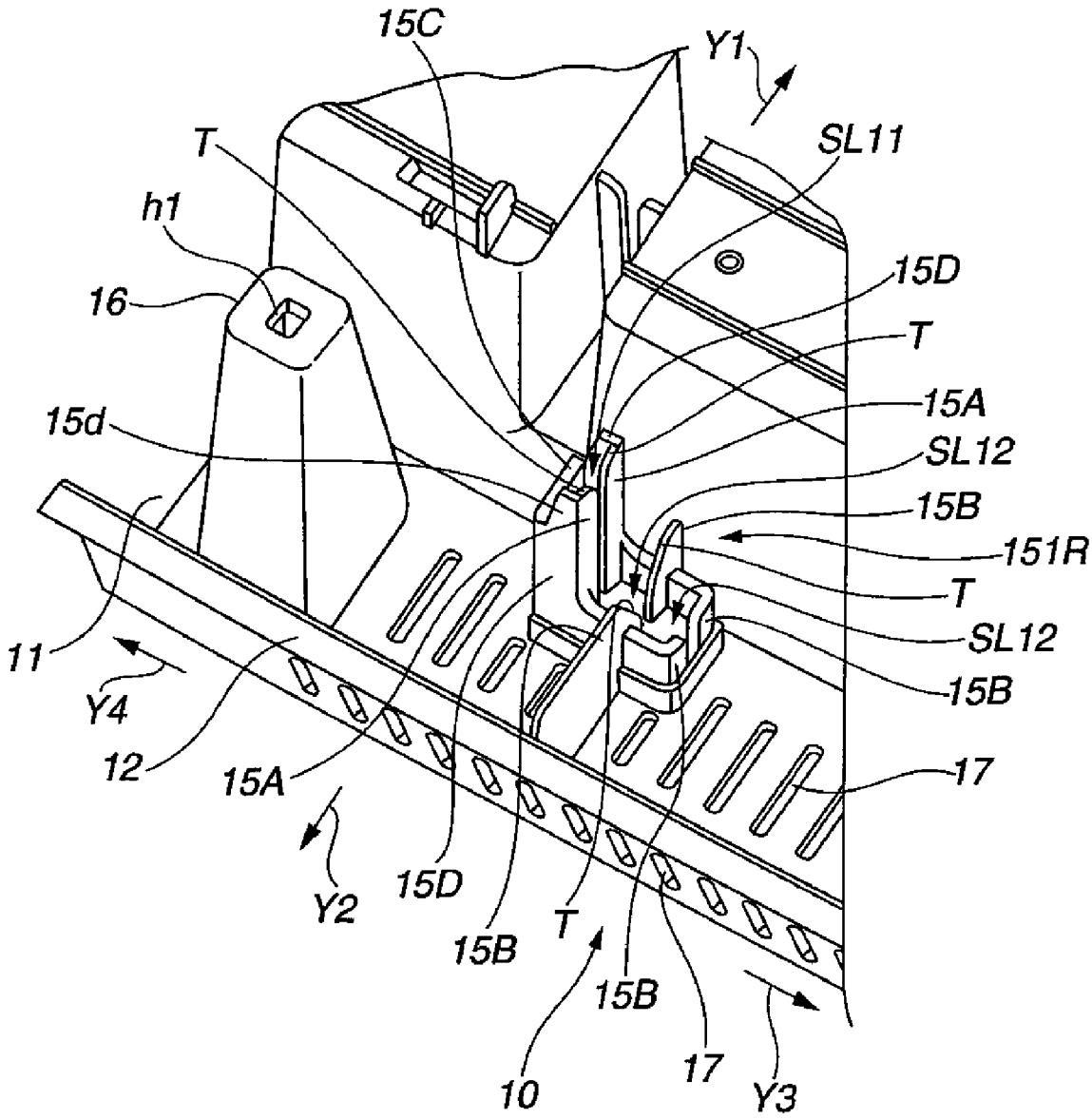
FIG. 3 is a fragmentary enlarged perspective view of the lower case shown in FIG. 1.
Figure 4:
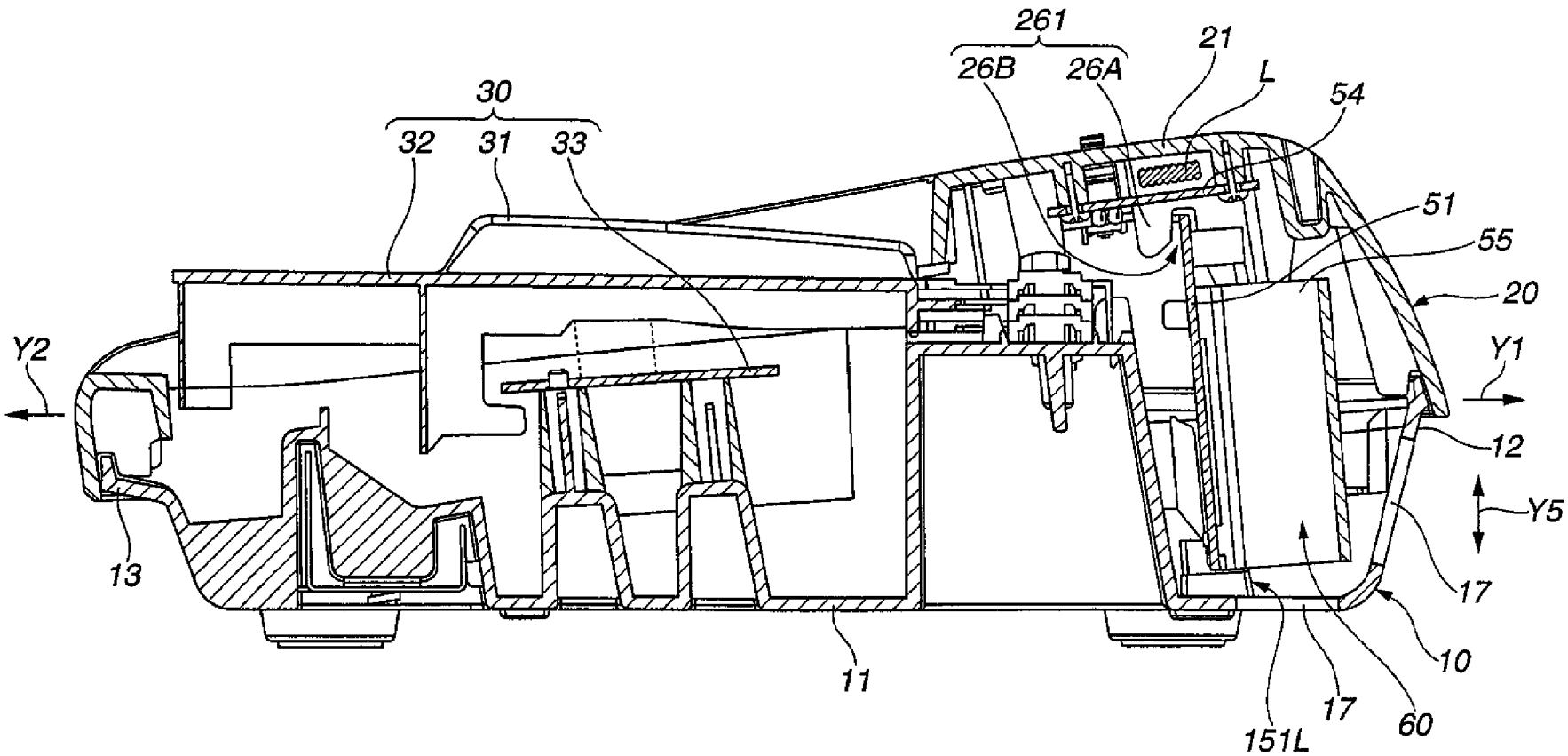
FIG. 4 is a sectional view of the electronic keyboard instrument, including the upper and lower cases, taken along the IV-IV line of FIG. 2.

FIG. 1A is a lower perspective view of an upper case 20 constituting a structure for an electronic keyboard instrument in accordance with an embodiment of the present invention, which particularly shows an inner or reverse side of the upper case 20. FIG. 1B is an upper perspective view of a lower case 10 constituting the structure together with the upper case 20. FIG. 2 is a fragmentary enlarged perspective view of the lower case 10 shown in FIG. 1. FIG. 3 is a fragmentary enlarged perspective view of the lower case 10 with an analog circuit board 51 for sound system circuitry removed therefrom. FIG. 4 is a sectional view of the electronic keyboard instrument, including the upper and lower cases 20 and 10, taken along the IV-IV line of FIG. 2. In the figures, arrow "Y1" indicates a "player side" in a front-back direction of the electronic keyboard instrument, arrow "Y2," indicates a side remote from the human player (i.e., remote-from-player side) in the front-back direction of the electronic keyboard instrument, arrow "Y3" indicates a left side as viewed from the human player in a key-arranged direction, arrow "Y4" indicates a right side as viewed from the human player in the key-arranged direction, and arrow "5" indicates a vertical direction of the electronic keyboard instrument. In the following description, the key-arranged direction is sometimes represented by reference numeral "Y3, Y4".

As shown in FIGS. 1A and 1B, the structure according to the embodiment of the invention comprises: the lower case 10 having a bottom plate 11 for mounting thereon a keyboard unit 30 (see FIG. 4) on a player-side portion thereof, and the upper case 20 having a roof or upper plate 21 for covering an upper portion of the lower case 10 and an operation section 22 provided on the upper surface of the upper plate 21. As shown in FIG. 4, the inventive structure for an electronic keyboard instrument is formed by a structure in which the upper case 20 is overlapped from above on upper-end peripheral regions of the lower case 10.

As shown in FIGS. 1A and 1B, the above-mentioned analog circuit board 51 and a digital circuit board 52 having musical signal formation circuitry, including a tone generator, provided thereon, are housed within the upper case 20 and lower case 10. These analog circuit board 51 and digital circuit board 52 are disposed in an upright posture parallel to the above-mentioned vertical direction Y5. The analog circuit board 51 and digital circuit board 52 are positioned in such a manner that their upper and lower edge portions E1 extend in a direction of arrows "Y6" parallel to the above-mentioned key-arranged direction Y3, Y4.

First, a construction of the lower case 10 will be detailed below. As shown in FIG. 1B, the lower case 10 has a back upwardly-extending wall section 12, front upwardly-extending wall section 13 and left and right upwardly-extending wall sections 14. The back upwardly-extending wall section 12 extends upward from the edge of a remote-from-player-side (or "Y2-side") portion of the bottom plate 11. The front upwardly-extending wall section 13 extends upward from the edge of a player-side (or "Y1-side") portion of the bottom plate 11. Further, the left and right upwardly-extending wall sections 14 extend from the opposite (left and right) longitudinal ends, in the key-arranged direction Y3, Y4, of the bottom plate 11.

The bottom platen of the lower case 10 has two pairs of first (or lower) circuit-board holding sections 151R, 151L and 152R, 152L, and lower bosses 16. The one pair of the first circuit-board holding sections 151R and 151L are provided for sandwichingly holding the lower edge portion E1 of the analog circuit board 51 and extend in the key-arranged direction Y3, Y4 in spaced-apart relation to each other. The other pair of the first circuit-board holding sections 152R and 152L, on the other hand, are provided for sandwichingly holding the lower edge portion E1 of the digital circuit board 52 and extend in the key-arranged direction Y3, Y4 in spaced-apart relation to each other.

As illustratively shown in FIG. 3, the first circuit-board holding section 151R comprises two first lower projecting portions 15A, two second lower projecting portions 15B, positioning wall portion 15C and connecting wall portions (or connecting portions) 15D, all of which are formed integrally. The other first circuit-board holding sections 151L, 152R and 152L are constructed in a similar manner to the first circuit-board holding sections 151R and thus will not be described in detail here to avoid unnecessary duplication.

The first and second lower projecting portions 15A and 15B are each formed on the remote-from-player-side portion of the bottom plate 11, i.e. on a portion of the bottom plate 11 between the keyboard unit 30 and the back upwardly-extending wall section 12. The first and second lower projecting portions 15A and 15B have first and second lower slits SL11 and SL12, respectively, each of which is open upwardly (i.e., toward the upper case 20) and extends through the corresponding projecting portion 15A or 15B in the key-arranged direction Y3, Y4. The first and second lower slits SL11 and SL12 each have a slit width substantially equal to the thickness of each of the analog circuit board 51 and digital circuit board 52. Further, the first lower projecting portion 15A has a greater height, from the upper surface of the bottom plate 11, than the second lower projecting portion 15B. Thus, the upward opening of the first lower slit SL11 is located closer to the upper case 20 than the upward opening of the second lower slit SL12.

In each of the first circuit-board holding sections 151R and 152R, located to the right (i.e., right side Y4) of the human player, the positioning wall portion 15C, first lower projecting portions 15A and second lower projecting portions 15B are disposed in a series or in alignment, in the mentioned order, along the key-arranged direction Y3, Y4 (i.e., in the extending direction of the upper and lower edge portions E1 of the corresponding circuit board). Similarly, in each of the first circuit-board holding sections 151L and 152L, located to the left (i.e., left side Y3) of the human player, the positioning wall portion 15C, first lower projecting portions 15A and second lower projecting portions 15B are disposed in a series or in alignment, in the mentioned order, along the key-arranged direction Y3, Y4.

Further, the first lower slit SL11 formed in the first lower projecting portion 15A and the two second lower slits SL12 formed in the two second lower projecting portions 15B are arranged in alignment substantially along the key-arranged direction Y3, Y4. The connecting wall portions 15D are formed to interconnect between the positioning wall portion 15C, first lower projecting portion 15A and second lower projecting portions 15B. Further, one of the two second lower projecting portions 15B, which is located closer to the first lower projecting portions 15A than the other second lower projecting portion 15B, constitutes a reinforcing rib portion that extends in the front-back direction beyond the connecting wall portion 15D and thereby reinforces the bottom plate 11.

Furthermore, the positioning wall portion 15C is provided to sandwichingly hold the analog circuit board 51 or digital circuit board 52 in the key-arranged direction Y3, Y4, i.e. in the extending direction Y6. The positioning wall portion 15C contacts a side edge portion E2, in the key-arranged direction Y3, Y4, of the analog circuit board 51 or digital circuit board 52, to thereby position the analog or digital circuit board 51 or 52 in the key-arranged direction Y3, Y4.

Each of the pairs of the first and second lower projecting portions 15A and 15B has a pair of tapered portions T opposed to each other in the front-back direction. Each of the tapered portions T is formed above the corresponding lower slit SL11 or SL12; the two tapered portions T in each of the pairs have respective upper surfaces that slant inwardly and downwardly to gradually approach each other in a top-to-bottom direction. Distance between the two tapered portions T in each of the pairs is set greater than the thickness of the corresponding analog circuit board 51 or digital circuit board 52.

Each of the lower bosses 16 is provided on the bottom plate 11 to project upwardly toward the upper case 20. Each of the lower bosses 16 has a threaded hole h1 formed therethrough in the vertical direction Y5. In the illustrated example, six such lower bosses 16 are provided in a row in the key-arranged directions Y3, Y4.

Next, a construction of the upper case 20 will be detailed in detail. As shown in FIG. 1A, the upper case 20 has a back downwardly-extending wall section 23, front downwardly-extending wall section 24 and left and right downwardly-extending wall sections 25. The upper plate 21 has a keyboard opening 21A for exposing the keyboard unit 30, and a speaker opening 21B for exposing a speaker (not shown). The back downwardly-extending wall section 23 extends downward from the edge of a remote-from-player-side (Y2-side) portion of the upper plate 21. The front downwardly-extending wall section 24 extends downward from the edge of a player-side (Y1-side) portion of the upper plate 21. Further, the left and right downwardly-extending wall sections 25 extend upwardly from the edge of left and right longitudinal end portions, in the key-arranged direction Y3, Y4, of the upper plate 21.

The upper case 20 has two pairs of second (or upper) circuit-board holding sections 261 and 262, and upper bosses 26. The second circuit-board holding sections 261 for sandwichingly holding the upper edge portion E1 of the analog circuit board 51 are disposed in spaced-apart alignment along the key-arranged direction Y3, Y4. The second circuit-board holding sections 262 for sandwichingly holding the upper edge portion E1 of the digital circuit board 52 are disposed in spaced-apart alignment along the key-arranged direction Y3, Y4.

As illustratively shown in FIGS. 1A and 1B and 4, each of the second circuit-board holding sections 261 has an upper projecting portion 26A that has an upper slit 26B formed therein. Each of the second circuit-board holding sections 262 is similar in construction to the second circuit-board holding sections 261 and will not be described to avoid unnecessary duplication. The upper projecting portion 26A is formed on a portion of the upper plate 21 located remote from the human player, i.e. on a remote-from-player-side portion of the upper plate 21 between the keyboard unit 30 and the back downwardly-extending wall section 23, and projects downwardly toward the lower case 10. The upper slit 26B is open downwardly (i.e., toward the lower case 10) and extends through the corresponding projecting portion in the key-arranged direction Y3, Y4. The upper slit 26B has a slit width substantially equal to the thickness of the corresponding circuit board 51 or 52.

The upper bosses 26 are provided on the reverse or underside of the upper plate 21 to project downwardly toward the lower case 10. The upper bosses 26 are formed at predetermined positions such that they are aligned with and placed on the corresponding lower bosses 16 of the lower case 10 as the upper case 20 and lower case 10 are assembled together in overlapped relation to each other.

The following paragraphs describe the analog circuit board 51 and digital circuit board 52 to be housed in the upper case 20 and lower case 10 of the structure. The analog circuit board 51 and digital circuit board 52 are each in the shape of a rectangular plate as viewed from the front. Heat radiating plate 55 is attached to the analog circuit board 51, as shown in FIGS. 2 and 4.

As shown in FIG. 2, the heat radiating plate 55 is in the form of a metal plate, which has concave and convex portions alternating in the key-arranged direction Y3, Y4. The concave and convex portions are formed by bending the metal plate. The heat radiating plate 55 is positioned on a remote-from-player side (Y2-side) of the analog circuit board 51. The heat radiating plate 55 is fixed in opposed relation to the analog circuit board 51 in such a manner that through-holes (through-passage spaces) 60 extending in the vertical direction Y5 are formed between the analog circuit board 51 and the concave and convex portions of the plate 55. Thus, the heat radiating plate 55 is positioned in such a manner that its surface B faces in the direction Y2 opposite from the human player.

Further, a plurality of heat radiating holes 17 for radiating heat, produced from the analog circuit board 51, to outside of the upper case 20 and lower case 10 are formed in portions of the bottom plate 11 and back upwardly-extending wall section 12 located near the analog circuit board 51. Namely, the heat radiating holes 17 are provided in the portion of the back upwardly-extending wall section 12 opposed to the surface B of the heat radiating plate 55.

Tapes (resilient or cushioning members) 70, each made of a resilient material, are affixed to portions of the analog circuit board 51 and digital circuit board 52 to be sandwiched by the first circuit-board holding sections 151R, 151L, 152R, 152L and second circuit-board holding sections 261, 262.

The following lines describe an operation-section circuit board 53 housed in the upper and lower cases 20 and 10 constructed in the aforementioned manner. The operation section 22 includes the operation-section circuit board 53, which is screwed to the lower surface of the upper plate 21 in parallel relation to the latter. Wiring section L drawn out from the operation section 22 is wired beneath and along the lower surface of the upper plate 21 and connected to the analog circuit board 51 and digital circuit board 52, as shown in FIG. 1A. Namely, the wiring section L has a portion wired to pass across a neighborhood of the upper end surface of the heat radiating plate 55. The portion of the wiring section L, wired to pass across the neighborhood of the upper end surface of the heat radiating plate 55, would be adversely influenced by heat produced from the analog circuit board 51 and flowing within the through-holes 60 in a bottom-to-top direction of the through-holes 60, so that inconveniences would be produced in the wiring section L.

Thus, in the instant embodiment of the invention, a heat blocking plate 54 is provided adjacent to the portion of the wiring section L disposed in the neighborhood of the upper end surface of the heat radiating plate 55 so that the wiring section L can be prevented from being influenced by the heat. The heat blocking plate 54 is mounted to the upper plate 21 by screwing with the wiring section L interposed between the heat blocking plate 54 and the upper plate 21. For this purpose, there may be used a circuit board blank integrally having a circuit board portion for the heat blocking plate 54 and a circuit board portion for the operation-section circuit board 53 with a perforated line therebetween, in which case the heat blocking plate 54 is cut or separated from the operation-section circuit board 53 along the perforated line. In other words, the heat blocking plate 54 is provided by being initially formed integrally with the operation-section circuit board 53 with a perforated line therebetween and then cut from the operation-section circuit board 53 along the perforated line.

As shown in FIG. 4, the keyboard unit 30, housed in the upper and lower cases 20 and 10 constructed in the aforementioned manner, includes a plurality of black keys 31 and white keys 32 arranged in the key-arranged direction Y3, Y4, and a switch circuit board 33. The switch circuit board 33 includes a plurality of switches each of which is turned on in response to depression of a corresponding one of the black and white keys 31 and 32.

The following lines describe a sequence of operations for assembling the structure for an electronic keyboard instrument constructed in the aforementioned manner. First, the wiring section L, drawn out from the operation section, is wired beneath and along the lower surface of the upper plate 21 in advance. Then, the circuit board blank, integrally having the circuit board portions for the heat blocking plate 54 and operation-section circuit board 53, is fixed by screwing to the lower surface of the upper plate 21 with the wiring section L interposed between the heat blocking plate 54 and the upper plate 21. After that, the circuit board blank is cut along the perforated line to be separated into the heat blocking plate 54 and operation-section circuit board 53.

Then, the heat radiating plate 55 is fixed to the analog circuit board 51 in overlapped relation to one side or surface of the analog board 51 so that the through-holes 60 extending in the vertical direction Y5 are formed between the analog circuit board 51 and the concave and convex portions of the heat radiating plate 55. The tapes (resilient or cushioning members) 70 are affixed to the portions of the analog circuit board 51 and digital circuit board 52 to be sandwiched by the first circuit-board holding sections 151R, 151L, 152R, 152L and second circuit-board holding sections 261, 262. Then, the respective upper edge portions E1 of the analog circuit board 51 and digital circuit board 52 are inserted into the upper slits 26B, formed in the upper projecting portions 26A, in such a manner that they are sandwiched or held by the upper projecting portions 26A of the second (or upper) circuit-board holding sections 261 and 262; at that time, the upper edge portion E1 of the analog circuit board 51 is held by the upper projecting portions 26A in such an orientation where the heat radiating plate 55, mounted to the analog circuit board 51, is located remote from the human player.

After that, the upper case 20 is overlapped from above on upper-end peripheral regions of the lower case 10 in such a manner that the respective lower edge portions E1 of the analog circuit board 51 and digital circuit board 52 are sequentially inserted in the first lower slits SL11 and second lower slits SL12 and the analog circuit board 51 and digital circuit board 52 are inserted between the corresponding opposed positioning wall portions 15C. More specifically, the analog circuit board 51 and digital circuit board 52 are first inserted in the first lower slits SL11 and thereby sandwichingly held (i.e., provisionally secured) by the first lower projecting portions 15A. At that time, the analog circuit board 51 and digital circuit board 52 can be readily introduced into the first lower slits SL11 by being guided along the tapered portions T formed in the first lower projecting portions 15A.

After that, the analog circuit board 51 and digital circuit board 52 are inserted into the second lower slits SL12 and thereby sandwichingly held by the second lower projecting portions 15B. At that time, the analog circuit board 51 and digital circuit board 52 can be readily introduced into the second lower slits SL12 by being guided along the tapered portions T formed in the second lower projecting portions 15B.

Then, the upper case 20 and lower case 10 are secured or fastened together by screws (fastening elements) inserted from below the lower case 10, through the screw holes h1 of the lower bosses 16, into screw holes h2 of the upper bosses 26. In this manner, the assembly of the structure for an electronic keyboard instrument is completed.

According to the above-described inventive structure for an electronic keyboard instrument, the upper case 20 and lower case 10 are fixed together by screwing with the upper case 20 overlapped on the upper-end peripheral regions of the lower case 10 in such a manner that the respective edge portions E1 of the analog circuit board 51 and digital circuit board 52 are inserted in the first and second lower slits SL11 and SL12 and the upper slits 26B and thereby sandwichingly held by the first and second projecting portions 15A and 15B and upper projecting portions 26A. The analog circuit board 51 and digital circuit board 52 can be sandwichingly held, in the vertical direction Y5, between the upper case 20 and the lower case 10 in the aforementioned manner, and thus, no separate screwing operation is required for attaching the analog circuit board 51 and digital circuit board 52 to the upper and lower cases 20 and 10. Further, because the analog circuit board 51 and digital circuit board 52 can be mounted to the upper and lower cases 20 and 10 as the upper case 20 is mounted to the lower case 10, the necessary assembling work can be performed easily in a simplified manner. Further, the analog circuit board 51 and digital circuit board 52 can function to mechanically reinforce the upper and lower cases 20 and 10 in the vertical direction Y5, so that the upper and lower cases 20 and 10 can be reliably prevented from deforming due to external force. Furthermore, because the upper and lower edge portions E1 of the analog circuit board 51 and digital circuit board 52 are sandwichingly held by the first and second projecting portions 15A and 15B and upper projecting portions 26A, the two circuit boards 51 and 52 can be reliably prevented from filling in the front-back direction and thus can be securely fixed within the upper and lower cases 20 and 10.

Furthermore, with the above-described inventive structure for an electronic keyboard instrument, where the heat radiating plate 55 is provided on the remote-from-player side (Y2-side) of the analog circuit board 51 and the surface B of the heat radiating plate 55 faces away from the player side (i.e., in the direction of arrow Y2), it is possible to prevent heat from being trapped in the keyboard unit 30. If the heat radiating plate 55 is disposed between the analog circuit board 51 and the keyboard unit 30, for example, heat would be trapped in the keyboard unit 30, so that imbalanced heat distribution would occur in a frame (that is formed of, for example, resin) of the keyboard unit 30. As a consequence, the frame of the keyboard unit 30 twists and the keyboard unit 30 loses flatness, so that uniformity among touch responses of the individual keys would be lowered and the performance capability of the keyboard would deteriorate. However, because the instant embodiment of the structure can prevent heat from being trapped in the keyboard unit 30, it can effectively prevent the uniformity among the touch response of the individual keys and performance capability of the keyboard from deteriorating due to heat from the analog circuit board 51.

Moreover, according to the above-described inventive structure for an electronic keyboard instrument, the heat radiating holes 17 are provided in a portion of the back upwardly-extending wall section 12 opposed to the heat radiating plate 55, and such heat radiating holes 17 can even further enhance the heat-radiating effect.

Furthermore, according to the above-described inventive structure, the heat radiating plate 55 is fixed to the analog circuit board 51 in overlapped relation thereto so that the through-holes 60 extending in the vertical direction Y5 are formed between the analog circuit board 51 and the concave and convex portions of the heat radiating plate 55, and thus, the analog circuit board 51 can be reinforced by the heat radiating plate 55. As a result, the analog circuit board 51 can even further reinforce the upper and lower cases 20 and 10, so that the cases 20 and 10 can be even more effectively prevented from deforming due to external force. In addition, because the through-holes (through-passage spaces) 60 form air passageways in the vertical direction Y5, it can even further enhance the heat-radiating effect.

Furthermore, according to the above-described inventive structure, the openings of the first lower slits SL11 are located closer to the upper case 20 than the openings of the second lower slits SL12, so that the analog circuit board 51 and digital circuit board 52 can be inserted first into the first lower slits SL11 and then into the second lower slits SL12. With such first and second lower slits SL11 and SL12 permitting insertion therein of the analog and digital circuit boards 51 and 52 with a time difference, the analog and digital circuit boards 51 and 52 can be attached smoothly to the lower case 10. Further, the first and second lower slits SL11 and SL12 can cooperate to properly align the analog and digital circuit boards 51 and 52 in the front-back-direction (i.e., thickness direction of the circuit boards 51 and 52).

Furthermore, according to the above-described inventive structure, the first and second lower slits SL11 and SL12 are arranged in alignment along the key-arranged direction Y3, Y4, and thus, the analog and digital circuit boards 51 and 52 can be attached to the lower case 10 even more smoothly. Moreover, the provision of two, or a plurality of, second lower projecting portions 15B and second lower slits SL12 allow the analog and digital circuit boards 51 and 52 to be attached to the lower case 10 even more smoothly. Furthermore, with the two second lower slits SL12 arranged in the extending direction Y6 (i.e., key-arranged direction Y3, Y4), the analog and digital circuit boards 51 and 52 can be attached to the lower case 10 even more smoothly.

Furthermore, according to the above-described inventive structure, the tapes (resilient members or cushioning members) 70 are affixed to the portions of the analog circuit board 51 and digital circuit board 52, and thus, the analog and digital circuit boards 51 and 52 can be securely fixed within the first and second lower slits SL11 and SL12 with no wobble. Consequently, it is possible to prevent mechanical noise from being produced in tones generated by the keyboard instrument and thereby prevent generation of buzzer-like sound noise.

Moreover, according to the above-described inventive structure, the provision of the positioning wall portions 15C allow the first and second lower slits SL11 and SL12 to be properly positioned in the key-arranged direction Y3, Y4. Besides, with the integral formation, via the connecting wall portion 15D, of the first and second lower projecting portions 15A and 15B, positioning wall portion 15C, the positioning wall portion 15C and first and second lower projecting portions 15A and 15B can be effectively reinforced.

Furthermore, the heat blocking plate 54, mounted to the upper plate 21 with the wiring section L interposed between the heat blocking plate 54 and the upper plate 21, is provided on a portion of the wiring section L which is wired to pass across a neighborhood of the upper end surface of the heat radiating plate 55. Consequently, the heat blocking plate 54 can block transfer of heat from the heat radiating plate 55, and thus, it is possible to prevent inconveniences from being produced in the wiring section L due to influences of the heat from the heat radiating plate 55.

Moreover, because the heat blocking plate 54 is provided by being cut, along the perforated line, from the circuit board blank integrally having circuit board portions for the heat blocking plate 54 and operation-section circuit board 53, it is possible to prevent the heat blocking plate 54 from being lost if it is kept integral with the operation-section circuit board 53 on the blank until the operation-section circuit board 53 and heat blocking plate 54 are attached to the upper and lower cases 20 and 10.

Whereas the lower case 10 in the above-described embodiment has the back upwardly-extending wall section 12, the present invention is not so limited. For example, the lower case 10 may have an opening formed in the remote-from-player-side portion thereof, and the upper case 20 may have a back plate to close the opening formed in the remote-from-player-side portion of the lower case 10. Namely, as long as the lower case 10 has at least the bottom plate 11 while the upper case 21 has at least the upper plate 21 and the upper case 20 is mountable from above to the lower case in overlapped relation thereto, the shapes of the two cases 20 and 10 are not limited to those in the above-described embodiment.

Furthermore, according to the above-described inventive structure, the bottom plate 11 of the lower case 10 has the first and second lower projecting portions 15A and 15B with the first and second lower slits S11 and S12 formed therein, but the present invention is not so limited. For example, if the bottom plate 11 has a sufficient thickness, the first and second lower slits S11 and S12 may be formed directly in the bottom plate 11 without the first and second lower projecting portions 15A and 15B being provided.

Moreover, according to the above-described inventive structure, the upper plate 21 of the upper case 10 has the upper projecting portions 26A each with the upper slit 26B formed therein, the present invention is not so limited. For example, if the upper plate 21 has a sufficient thickness, the upper slits 26A may be formed directly in the upper plate 21 without the upper projecting portions 26A being provided.

Furthermore, whereas the heat radiating plate 55 in the above-described embodiment is provided on the remote-from-player side of the analog circuit board 51 in such a manner that the surface B faces away from the player side (i.e., in the direction of arrow Y2), the present invention is not so limited, and the shape and position of the heat radiating plate 55 are not limited to those in the above-described embodiment.

Furthermore, whereas each of the circuit-board holding sections 151R, 151L, 152R and 152L in the above-described embodiment has two second lower projecting portions 15B and two second lower slits SL12, the present invention is not so limited. For example, each of the circuit-board holding sections 151R, 151L, 152R and 152L may have only one or more than two second lower projecting portions 15B and second lower slits SL12.

Furthermore, whereas each of the circuit-board holding sections 151R, 151L, 152R and 152L in the above-described embodiment has the second lower projecting portions 15B and second lower slits SL12, the present invention is not so limited. For example, each of the circuit-board holding sections 151R, 151L, 152R and 152L may have no such lower projecting portion 15B and second lower slit SL12.

Moreover, whereas the positioning wall portion 15C and first and second lower projecting portion 15A and 15B are interconnected via the connecting wall portion 15D in the above-described embodiment, the present invention is not so limited. If the positioning wall portion 15C and first and second lower projecting portion 15A and 15B each have a sufficient mechanical strength, for example, they need not necessarily be interconnected via the connecting wall portion 15D.

Furthermore, whereas each of the circuit-board holding sections 151R, 151L, 152R and 152L in the above-described embodiment has the positioning wall portion 15C, the present invention is not so limited. For example, each of the circuit-board holding sections 151R, 151L, 152R and 152L need not have the positioning wall portion 15C.

Moreover, whereas the heat blocking plate 54 in the above-described embodiment is provided by being cut, along the perforated line, from the circuit board blank integrally having circuit board portions for the heat blocking plate 54 and operation-section circuit board 53, the present invention is not so limited, and the heat blocking plate 54 and the operation-section circuit board 53 may be fabricated separately.

Furthermore, in the above-described embodiment, the tapes 70 are affixed, as the resilient or cushioning means, to the outer surfaces of the analog circuit board 51 and digital circuit board 52. However, the present invention is not so limited; for example, such tapes 70 may be affixed to the inner surfaces of the first and second lower slits SL11 and SL12 and upper slits 26B.

Moreover, the first circuit-board holding sections 151R, 151L, 152R and 152L and the second circuit-board holding sections 261 and 262 are not limited to those in the above-described embodiment. For example, the analog circuit board 51 and digital circuit board 52 may each be sandwichingly held in the thickness direction by at least one of the first and second lower projecting portions 15A and 15B and the upper projecting portions 26A. In such a case, each of the first and second lower projecting portions 15A and 15B is tapered in such a manner that the slit formed therein has a width gradually decreasing in the downward direction, while each of the upper projecting portions 26A is tapered in such a manner that the slit formed therein has a width gradually decreasing in the upward direction. By pressing the analog circuit board 51 and digital circuit board 52 into such first and second lower slits SL11 and SL12 and upper slits 26B, it is possible to prevent buzzer-like sound noise during generation of tones, even without the above-mentioned tapes (resilient means) 70.

Furthermore, in the above-described embodiment, the lower and upper edge portions E1 of the analog and digital circuit boards 51 and 52 are held in contact with the bottom surfaces of the first and second lower slits SL11 and SL12 and upper slits 26B, respectively. However, the present invention is not so limited. For example, the analog circuit board 51 and digital circuit board 52 may be sandwichingly held in the thickness direction by the first and second lower projecting portions 15A and 15B and upper projecting portions 26A with their edges spaced from at least one of the bottom surfaces of the first and second lower slits SL11 and SL12 and the bottom surfaces of the upper slits 26B. In such a case, a rubber adhesive agent may be poured into the gaps formed between the edges of the analog circuit board 51 and digital circuit board 52 and the bottom surfaces of the first and second lower slits SL11 and SL12 and/or the bottom surfaces of the upper slits 26B; thus, the analog and digital circuit boards 51 and 52 can be securely fixed within the first and second lower slits SL11 and SL12 and the analog and digital circuit boards 51 and 52 can be securely fixed within the first and second lower slits SL11 and SL12 with no wobble, so that it is possible to prevent buzzer-like sound noise during generation of tones generated by the keyboard instrument.

Whereas the foregoing have described representative preferred embodiments of the present invention, various other modifications are also possible without departing from the basic concept of the present invention.

This application is based on, and claims priority to, JP PA 2007-000837 filed on 5 Jan. 2007 and JP PA 2007-000838 filed on 5 Jan. 2007. The disclosure of the priority applications, in its entirety, including the drawings, claims, and the specification thereof, is incorporated herein by reference.

What is claimed is:

1. A structure for an electronic keyboard instrument which comprises a lower case having a bottom plate for mounting thereon a keyboard unit and an upper case having an upper plate covering the lower case, said structure further comprising:

a first holding section provided on the bottom plate of said lower case and having a lower slit formed therein, the lower slit having an upward opening;

a second holding section provided on the upper plate of said upper case and having an upper slit formed therein, the upper slit having a downward opening; and a circuit board with an upper edge portion and a lower edge portion, said circuit board disposed upright between said upper case and said lower case;

wherein, as the upper and lower cases are mounted together, the circuit board is mounted to the upper and lower cases such that said circuit board is fixed in place by being inserted at the upper and lower edge portions thereof in the upper slit and lower slit, respectively; and wherein the insertion of the upper edge portion of the circuit board into the upper slit is independent of the insertion of the lower edge portion of the circuit board into the lower slit.

2. The structure for an electronic keyboard instrument as defined in claim 1 wherein said first holding section is provided on a portion of the bottom plate remoter from a human player of the keyboard instrument than the keyboard unit, said second holding section is provided on a portion of said upper plate remoter from the human player than the keyboard unit, and said upper case and said lower case are fastened together via fastening means with said lower case covered with said upper case.

3. The structure for an electronic keyboard instrument as claimed in claim 1 wherein a heat radiating plate is disposed on a side of said circuit board remote from the human player.

4. The structure for an electronic keyboard instrument as claimed in claim 1 which includes a heat radiating plate having concave and convex portions, and wherein said heat radiating plate is provided in opposed relation to said circuit board in such a manner that vertical through-spaces are formed between said circuit board and the concave and convex portions.

5. The structure for an electronic keyboard instrument as claimed in claim 4 wherein said first lower slit and said second lower slit are arranged in alignment substantially along a key-arranged direction.

6. The structure for an electronic keyboard instrument as claimed in claim 1 wherein the lower slit of said first holding section includes first and second lower slits provided in such a manner that said circuit board is first inserted into said first lower slit and then inserted into said second lower slit following the insertion into said first lower slit.

7. The structure for an electronic keyboard instrument as claimed in claim 1 wherein the lower slit of said first holding section includes first and second lower slits, and an opening of the first lower slit is located closer to said upper case than an opening of the second lower slit.

8. The structure for an electronic keyboard instrument as claimed in claim 1 which includes a resilient or cushioning member provided on at least one of outer surfaces of said circuit board and inner surfaces of said slit.

9. The structure for an electronic keyboard instrument as claimed in claim 1 wherein said first holding section includes: a lower projecting portion that projects from the bottom plate toward the upper case and has the lower slit formed therein; a positioning wall portion that projects from the bottom plate toward the upper case and positions said circuit board in a key-arranged direction; and a connecting portion that interconnects the lower projecting portion and the positioning wall portion.

10. The structure for an electronic keyboard instrument as claimed in claim 1 wherein said first holding section includes: first and second lower projecting portions each having the lower slit formed therein; and a connecting portion that interconnects said first and second lower projecting portions, and wherein said first and second lower projecting portions and said connecting portion are formed integrally with each other.

11. A structure for an electronic keyboard instrument which comprises a lower case having a bottom plate for mounting thereon a keyboard unit and an upper case having an upper plate covering the lower case, said structure further comprising:

a first holding section provided on the bottom plate of said lower case and having a lower slit formed therein, the lower slit having an upward opening;

a second holding section provided on the upper plate of said upper case and having an upper slit formed therein, the upper slit having a downward opening;

a circuit board disposed upright between said upper case and said lower case, wherein, when said lower case is covered with said upper case, said circuit board is fixed in place by being inserted at upper and lower edge portions thereof in the upper slit and lower slit, respectively;

an operation section mounted on an upper surface of the upper plate of the upper case;

a heat-radiating plate attached to said circuit board;

a wiring drawn out from the operation section and wired to pass across a neighborhood of an upper end surface of said heat radiating plate at least under a lower surface of the upper plate; and a heat blocking plate mounted to the upper plate, wherein said heat blocking plate is provided between said heat radiating plate and said wiring, said heat blocking plate blocking transfer of heat from said heat radiating plate to said wiring.

12. The structure for an electronic keyboard instrument as claimed in claim 11 wherein said operation section includes an operation-section circuit board provided beneath and along the lower surface of the upper plate, and said heat blocking plate is provided by being initially formed integrally with said operation-section circuit board with a perforated line therebetween and then cut from said operation-section circuit board along the perforated line.

* * * * *